US011781793B2

(12) United States Patent
Goel et al.

(10) Patent No.: US 11,781,793 B2
(45) Date of Patent: Oct. 10, 2023

(54) CONTROL SYSTEMS AND METHODS FOR PREVENTING EVAPORATOR COIL FREEZE

(71) Applicant: Lennox Industries Inc., Richardson, TX (US)

(72) Inventors: Rakesh Goel, Irving, TX (US); Siddarth Rajan, Addison, TX (US)

(73) Assignee: Lennox Industries Inc., Richardson, TX (US)

( * ) Notice: Subject to any disclaimer, the term of this patent is extended or adjusted under 35 U.S.C. 154(b) by 275 days.

(21) Appl. No.: 17/123,702

(22) Filed: Dec. 16, 2020

(65) Prior Publication Data

US 2022/0186996 A1 Jun. 16, 2022

(51) Int. Cl.
*F25B 47/00* (2006.01)
*F24F 3/14* (2006.01)

(52) U.S. Cl.
CPC ..... *F25B 47/006* (2013.01); *F24F 3/14* (2013.01); *F24F 2003/144* (2013.01); *F25B 2339/02* (2013.01); *F25B 2347/00* (2013.01); *F25B 2600/21* (2013.01); *F25B 2700/2117* (2013.01)

(58) Field of Classification Search
CPC .... F25B 47/00; F25B 47/006; F25B 2347/00; F24F 3/1405; F24F 11/41; F24F 11/80
See application file for complete search history.

(56) References Cited

U.S. PATENT DOCUMENTS

| | | | | |
|---|---|---|---|---|
| 4,189,929 | A * | 2/1980 | Russell | F25B 49/02 62/176.5 |
| 4,825,662 | A * | 5/1989 | Alsenz | G05D 23/1912 62/175 |
| 5,062,276 | A | 11/1991 | Dudley | |
| 5,628,201 | A | 5/1997 | Sahel et al. | |
| 7,975,495 | B2 | 7/2011 | Voorhis et al. | |
| 9,772,124 | B2 | 9/2017 | Wintemute et al. | |
| 10,066,860 | B2 | 9/2018 | Downie et al. | |
| 10,295,217 | B2 | 5/2019 | Goel | |
| 10,386,089 | B2 | 8/2019 | Goel et al. | |
| 2010/0082161 | A1 | 4/2010 | Patch | |
| 2013/0014521 | A1* | 1/2013 | Lukasse | F25D 21/04 62/80 |
| 2014/0260368 | A1 | 9/2014 | Wintemute et al. | |
| 2015/0285526 | A1* | 10/2015 | Smith | F24F 11/64 700/276 |
| 2015/0337831 | A1 | 11/2015 | Zhou et al. | |

(Continued)

OTHER PUBLICATIONS

U.S. Appl. No. 17/181,174, Goel.

*Primary Examiner* — Jerry-Daryl Fletcher
*Assistant Examiner* — Daniel C Comings
(74) *Attorney, Agent, or Firm* — Bradley Arant Boult Cummings

(57) ABSTRACT

In an embodiment, a method of preventing evaporator coil freeze in a heating, ventilation and air conditioning (HVAC) system is performed by a controller in the HVAC system. The method includes determining a reference saturated suction temperature (SST) via a sensor disposed in relation to an evaporator coil in the HVAC system. The method also includes determining whether the reference SST is below a minimum SST threshold. The method also includes, responsive to a determination that the reference SST is below the minimum SST threshold, increasing a discharge air temperature (DAT) setpoint.

16 Claims, 9 Drawing Sheets

(56) References Cited

U.S. PATENT DOCUMENTS

| | | | |
|---|---|---|---|
| 2016/0273815 | A1 | 9/2016 | Downie et al. |
| 2016/0327323 | A1 | 11/2016 | Goel |
| 2017/0010032 | A1 | 1/2017 | Goel et al. |
| 2017/0153037 | A1 | 6/2017 | Goel et al. |
| 2017/0227246 | A1 | 8/2017 | Rajan et al. |
| 2017/0234564 | A1 | 8/2017 | Goel et al. |
| 2017/0356668 | A1 | 12/2017 | Goel |
| 2017/0356671 | A1 | 12/2017 | Goel |
| 2018/0372359 | A1 | 12/2018 | Goel |
| 2019/0277533 | A1 | 9/2019 | Goel et al. |
| 2019/0323722 | A1 | 10/2019 | Goel et al. |
| 2020/0096236 | A1 | 3/2020 | Rajan et al. |
| 2020/0173683 | A1 | 6/2020 | Goel et al. |
| 2020/0240692 | A1 | 7/2020 | Gokhale et al. |
| 2020/0355418 | A1 | 11/2020 | Najafifard |

* cited by examiner

CONTROL SYSTEMS AND METHODS FOR PREVENTING EVAPORATOR COIL FREEZE

TECHNICAL FIELD

The present disclosure relates generally to heating, ventilation, and air conditioning (HVAC) systems and more particularly, but not by way of limitation, to control systems and methods for preventing evaporator coil freeze.

BACKGROUND

HVAC systems are used to regulate environmental conditions within an enclosed space. Typically. HVAC systems have a circulation fan that pulls air from the enclosed space through ducts and pushes the air back into the enclosed space through additional ducts after conditioning the air (e.g., heating, cooling, humidifying, or dehumidifying the air). To direct operation of the circulation fan and other components. HVAC systems include a controller. In addition to directing operation of the HVAC system, the controller may be used to monitor various components. (i.e. equipment) of the HVAC system to determine if the components are functioning properly.

SUMMARY

A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

In an embodiment, one general aspect includes a method of preventing evaporator coil freeze in a heating, ventilation and air conditioning (HVAC) system. The method is performed by a controller in the HVAC system. The method includes determining a reference saturated suction temperature (SST) via a sensor disposed in relation to an evaporator coil in the HVAC system. The method also includes determining whether the reference SST is below a minimum SST threshold. The method also includes, responsive to a determination that the reference SST is below the minimum SST threshold, increasing a discharge air temperature (DAT) setpoint. Other embodiments of this aspect include corresponding computer systems, apparatus, and computer programs recorded on one or more computer storage devices, each configured to perform the actions of the methods.

In an embodiment, another general aspect includes a heating, ventilation and air conditioning (HVAC) system. The HVAC system includes an evaporator coil, a sensor disposed in relation to the evaporator coil, and a compressor fluidly coupled to a condenser coil and the evaporator coil. The HVAC system also includes a controller operatively coupled to the compressor, where the controller is operable to perform a method. The method includes determining a reference saturated suction temperature (SST) via a sensor disposed in relation to an evaporator coil in the HVAC system. The method also includes determining whether the reference SST is below a minimum SST threshold. The method also includes, responsive to a determination that the reference SST is below the minimum SST threshold, increasing a discharge air temperature (DAT) setpoint.

In an embodiment, another general aspect includes a computer-program product that includes a non-transitory computer-usable medium having computer-readable program code embodied therein. The computer-readable program code is adapted to be executed to implement a method. The method includes determining a reference saturated suction temperature (SST) via a sensor disposed in relation to an evaporator coil in the HVAC system. The method also includes determining whether the reference SST is below a minimum SST threshold. The method also includes, responsive to a determination that the reference SST is below the minimum SST threshold, increasing a discharge air temperature (DAT) setpoint.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
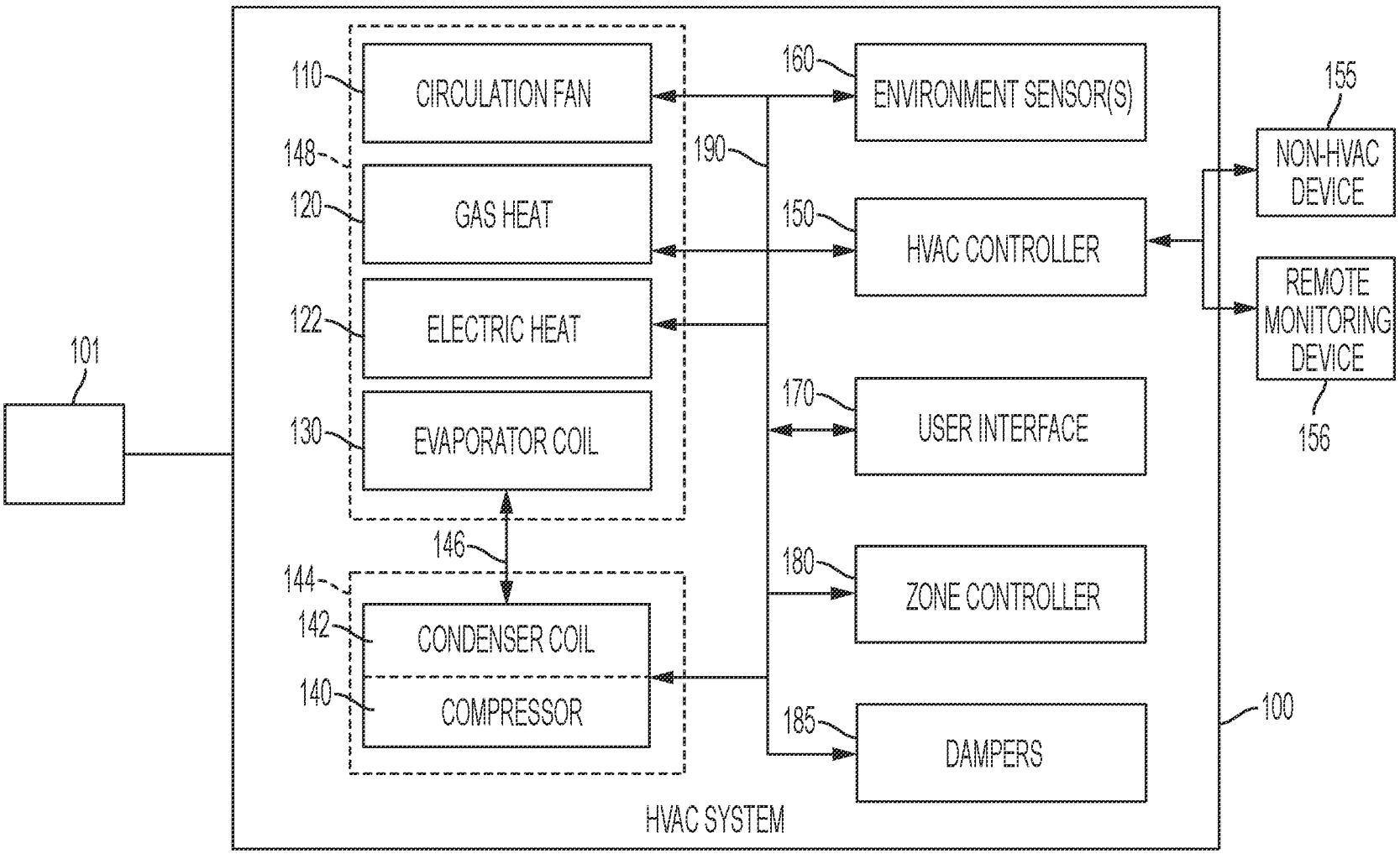
FIG. 1 is a block diagram of an exemplary HVAC system.

Various embodiments of the present disclosure will now be described more fully with reference to the accompanying drawings. The invention may, however, be embodied in many different forms and should not be construed as limited to the embodiments set forth herein.

HVAC systems are frequently utilized to adjust both temperature of conditioned air as well as relative humidity of the conditioned air. A cooling capacity of an HVAC system is a combination of the HVAC system's sensible cooling capacity and latent cooling capacity. Sensible cooling capacity refers to an ability of the HVAC system to remove sensible heat from conditioned air. Latent cooling capacity refers to an ability of the HVAC system to remove latent heat from conditioned air. In a typical embodiment, sensible cooling capacity and latent cooling capacity vary with environmental conditions. Sensible heat refers to heat that, when added to or removed from the conditioned air, results in a temperature change of the conditioned air. Latent heat refers to heat that, when added to or removed from the conditioned air, results in a phase change of, for example, water within the conditioned air. Sensible-to-total ratio ("S/T ratio") is a ratio of sensible heat to total heat (sensible heat+latent heat). The lower the S/T ratio, the higher the latent cooling capacity of the HVAC system for given environmental conditions.

Sensible cooling load refers to an amount of heat that must be removed from the enclosed space to accomplish a desired temperature change of the air within the enclosed space. The sensible cooling load is reflected by a temperature within the enclosed space as read, for example, on a dry-bulb thermometer. Latent cooling load refers to an amount of heat that must be removed from the enclosed space to accomplish a desired change in humidity of the air within the enclosed space. The latent cooling load is reflected by a temperature within the enclosed space as read, for example, on a wet-bulb thermometer. Setpoint or temperature setpoint refers to a target temperature setting of the HVAC system as set by a user or automatically based on a pre-defined schedule. Discharge air temperature (DAT) refers to a temperature of air leaving an evaporator coil. Typically, DAT is maintained at a constant pre-set level. DAT varies with indoor dry-bulb air temperature, indoor wet-bulb air temperature, indoor air flow rate, cooling capacity of the HVAC system, and other design parameters.

When there is a high sensible cooling load such as, for example, when outside-air temperature is significantly warmer than an inside-air temperature setpoint, the HVAC system will continue to operate in an effort to effectively cool and dehumidify the conditioned air. Such operation is commonly referred to as "cooling mode." When there is a low sensible cooling load but high relative humidity such as, for example, when the outside air temperature is relatively close to the inside air temperature setpoint, but the outside air is considerably more humid than the inside air, additional steps must be undertaken to increase the moisture-removal capability of the HVAC system to avoid occupant discomfort. This is commonly referred to as "dehumidification mode." Additionally, limiting indoor blower speed to a speed below Normal cooling cubic feet per minute (CFM) ensures that the S/T ratio does not rise above, for example, 0.8. Maintaining the S/T ratio below, for example, 0.8 maintains latent capacity of the HVAC system. Additionally, when there is a low sensible cooling load, lowering the DAT according to the temperature of the enclosed space lowers the S/T ratio and increases the latent capacity of the HVAC system.

While lowering DAT can be advantageous in many respects, it generally has the effect of lowering saturation suction temperature. Saturation suction temperature (SST) refers to saturated refrigerant temperature at suction pressure leaving an evaporator, or any measurement used as a proxy for such temperature. If the SST approaches a freezing point of the refrigerant, frost will begin to form on the evaporator coil. This situation is often referred to as evaporator coil freeze. Evaporator coil freeze causes an increased risk of damage to the evaporator coil and other components of the HVAC system. This problem can be particularly common in HVAC systems that include more than compressor, as the presence of multiple circuits in the evaporator coil, some of which are more downstream than others, can result in wide variation in SST throughout the evaporator coil.

The present disclosure describes examples of control systems and methods that enable DAT to be safely modulated, for example, during dehumidification mode, with a greatly reduced risk of evaporator coil freeze. In various embodiments, a controller of an HVAC system monitors SST and causes a DAT setpoint to be algorithmically adjusted based, at least in part, on the SST. For example, the DAT setpoint can be algorithmically increased as the SST falls beneath a configurable minimum temperature, or whenever the SST indicates a trend towards evaporator coil freeze. Afterwards, the DAT setpoint can be algorithmically decreased towards its previous level as the SST moves toward or exceeds the configurable minimum temperature, or whenever the SST indicates a trend away from evaporator coil freeze. Examples will be described below with reference to the Drawings.

FIG. 1 illustrates an HVAC system 100. In a typical embodiment, the HVAC system 100 is a networked HVAC system that is configured to condition air via, for example, heating, cooling, humidifying, or dehumidifying air within an enclosed space 101. In a typical embodiment, the enclosed space 101 is, for example, a house, an office building, a warehouse, and the like. Thus, the HVAC system 100 can be a residential system or a commercial system such as, for example, a roof top system. For exemplary illustration, the HVAC system 100 as illustrated in FIG. 1 includes various components; however, in other embodiments, the HVAC system 100 may include additional components that are not illustrated but typically included within HVAC systems.

The HVAC system 100 includes a variable-speed circulation fan 110, a gas heat 120, electric heat 122 typically associated with the variable-speed circulation fan 110, and a refrigerant evaporator coil 130, also typically associated with the variable-speed circulation fan 110. The variable-speed circulation fan 110, the gas heat 120, the electric heat 122, and the refrigerant evaporator coil 130 are collectively referred to as an "indoor unit" 148. In a typical embodiment, the indoor unit 148 is located within, or in close proximity to, the enclosed space 101. The HVAC system 100 also includes a variable-speed compressor 140 and an associated condenser coil 142, which are typically referred to as an "outdoor unit" 144. In various embodiments, the outdoor unit 144 is, for example, a rooftop unit or a ground-level unit. The variable-speed compressor 140 and the associated condenser coil 142 are connected to an associated evaporator coil 130 by a refrigerant line 146. In a typical embodiment, the variable-speed compressor 140 is, for example, a single-stage compressor, a multi-stage compressor, a single-speed compressor, or a variable-speed compressor. The variable-speed circulation fan 110, sometimes referred to as a blower, is configured to operate at different capacities (i.e., variable motor speeds) to circulate air through the HVAC system 100, whereby the circulated air is conditioned and supplied to the enclosed space 101.

Figure 3:
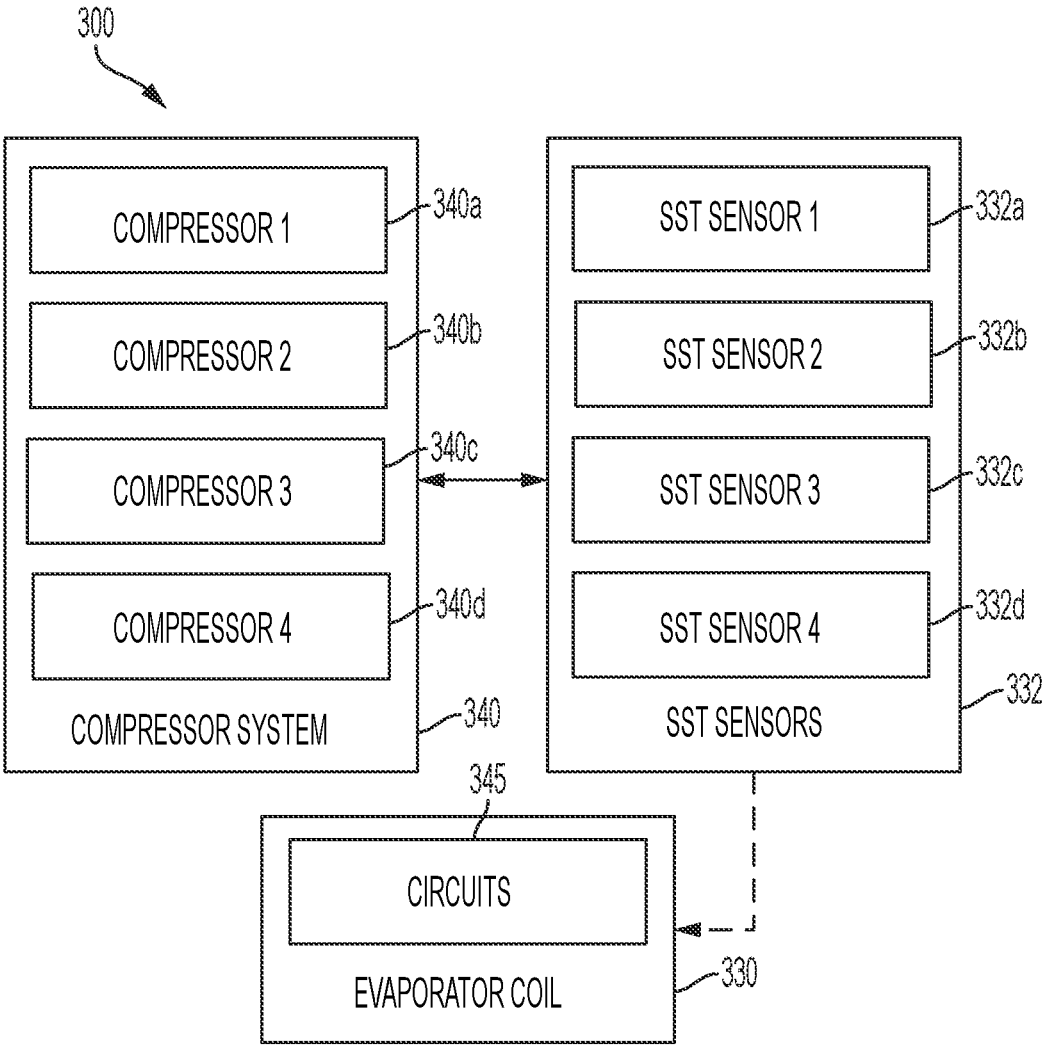
FIG. 3 illustrates an example implementation involving multiple compressors.

In various embodiments, as described in greater relative to FIG. 3, the variable-speed compressor 140 may be representative of a compressor system 340 including multiple compressors of the same or different capacities, one or more of which may be variable-speed compressors. In these embodiments, such compressors may include any appropriate arrangement of compressors (e.g., in series and/or in parallel). In some of these embodiments, such compressors may operate in tandem and share discharge lines and suction lines. In addition, or alternatively, such compressors may be independently operable in some implementations. For example, a first compressor may be allowed to operate and a second compressor may be restricted from operation. Compressor operations may include full-load operations and part-load operations. A full-load operation may include operation of each compressor. A part-load operation may include allowing operation of one or more compressors and restricting operation of one or more other compressors. In some implementations, a part-load operation may include operation of a multistage compressor at one of the low settings (e.g., when a compressor includes a high setting and at least one low setting).

In embodiments in which the variable-speed compressor 140 is representative of multiple compressors, the evaporator coil 130 may include a plurality of evaporator circuits that are apportioned among the compressors according to a suitable circuiting arrangement, where each compressor operates off of the evaporator circuits apportioned thereto. For example, in various embodiments, the evaporator coil 130 may implement a row-split or intertwined circuiting arrangement. Although the variable-speed compressor 140 can be representative of multiple compressors as described above, for simplicity of description and illustration, the variable-speed compressor 140 will be illustrated and described singly.

Still referring to FIG. 1, the HVAC system 100 includes an HVAC controller 150 that is configured to control operation of the various components of the HVAC system 100 such as, for example, the variable-speed circulation fan 110, the gas heat 120, the electric heat 122, and the variable-speed compressor 140 to regulate the environment of the enclosed space 101. In some embodiments, the HVAC system 100 can be a zoned system. In such embodiments, the HVAC system 100 includes a zone controller 180, dampers 185, and a plurality of environment sensors 160. In a typical embodiment, the HVAC controller 150 cooperates with the zone controller 180 and the dampers 185 to regulate the environment of the enclosed space 101.

The HVAC controller 150 may be an integrated controller or a distributed controller that directs operation of the HVAC system 100. In a typical embodiment, the HVAC controller 150 includes an interface to receive, for example, thermostat calls, temperature setpoints, blower control signals, environmental conditions, and operating mode status for various zones of the HVAC system 100. For example, in a typical embodiment, the environmental conditions may include indoor temperature and relative humidity of the enclosed space 101. In a typical embodiment, the HVAC controller 150 also includes a processor and a memory to direct operation of the HVAC system 100 including, for example, a speed of the variable-speed circulation fan 110.

Still referring to FIG. 1, in some embodiments, the plurality of environment sensors 160 are associated with the HVAC controller 150 and also optionally associated with a user interface 170. The plurality of environment sensors 160 provide environmental information within a zone or zones of the enclosed space 101 such as, for example, temperature and humidity of the enclosed space 101 to the HVAC controller 150. The plurality of environment sensors 160 may also send the environmental information to a display of the user interface 170. In some embodiments, the user interface 170 provides additional functions such as, for example, operational, diagnostic, status message display, and a visual interface that allows at least one of an installer, a user, a support entity, and a service provider to perform actions with respect to the HVAC system 100. In some embodiments, the user interface 170 is, for example, a thermostat of the HVAC system 100. In other embodiments, the user interface 170 is associated with at least one sensor of the plurality of environment sensors 160 to determine the environmental condition information and communicate that information to the user. The user interface 170 may also include a display, buttons, a microphone, a speaker, or other components to communicate with the user. Additionally, the user interface 170 may include a processor and memory that is configured to receive user-determined parameters such as, for example, a relative humidity of the enclosed space 101, and calculate operational parameters of the HVAC system 100 as disclosed herein.

In a typical embodiment, the HVAC system 100 is configured to communicate with a plurality of devices such as, for example, a communication device 155, a monitoring device 156, and the like. In a typical embodiment, the monitoring device 156 is not part of the HVAC system. For example, the monitoring device 156 is a server or computer of a third party such as, for example, a manufacturer, a support entity, a service provider, and the like. In other embodiments, the monitoring device 156 is located at an office of, for example, the manufacturer, the support entity, the service provider, and the like.

In a typical embodiment, the communication device 155 is a non-HVAC device having a primary function that is not associated with HVAC systems. For example, non-HVAC devices include mobile-computing devices that are configured to interact with the HVAC system 100 to monitor and modify at least some of the operating parameters of the HVAC system 100. Mobile computing devices may be, for example, a personal computer (e.g., desktop or laptop), a tablet computer, a mobile device (e.g., smart phone), and the like. In a typical embodiment, the communication device 155 includes at least one processor, memory and a user interface, such as a display. One skilled in the art will also understand that the communication device 155 disclosed herein includes other components that are typically included in such devices including, for example, a power supply, a communications interface, and the like.

The zone controller 180 is configured to manage movement of conditioned air to designated zones of the enclosed space 101. Each of the designated zones include at least one conditioning or demand unit such as, for example, the gas heat 120 and at least one user interface 170 such as, for example, the thermostat. The zone-controlled HVAC system 100 allows the user to independently control the temperature in the designated zones. In a typical embodiment, the zone controller 180 operates electronic dampers 185 to control air flow to the zones of the enclosed space 101.

In some embodiments, a data bus 190, which in the illustrated embodiment is a serial bus, couples various components of the HVAC system 100 together such that data is communicated therebetween. In a typical embodiment, the data bus 190 may include, for example, any combination of hardware, software embedded in a computer readable medium, or encoded logic incorporated in hardware or otherwise stored (e.g., firmware) to couple components of the HVAC system 100 to each other. As an example and not by way of limitation, the data bus 190 may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus 190 may include any number, type, or configuration of data buses 190, where appropriate. In particular embodiments, one or more data buses 190 (which may each include an address bus and a data bus) may couple the HVAC controller 150 to other components of the HVAC system 100. In other embodiments, connections between various components of the HVAC system 100 are wired. For example, conventional cable and contacts may be used to couple the HVAC controller 150 to the various components. In some embodiments, a wireless connection is employed to provide at least some of the connections between components of the HVAC system such as, for example, a connection between the HVAC controller 150 and the variable-speed circulation fan 110, the variable-speed compressor 140, or the plurality of environment sensors 160.

Figure 2:
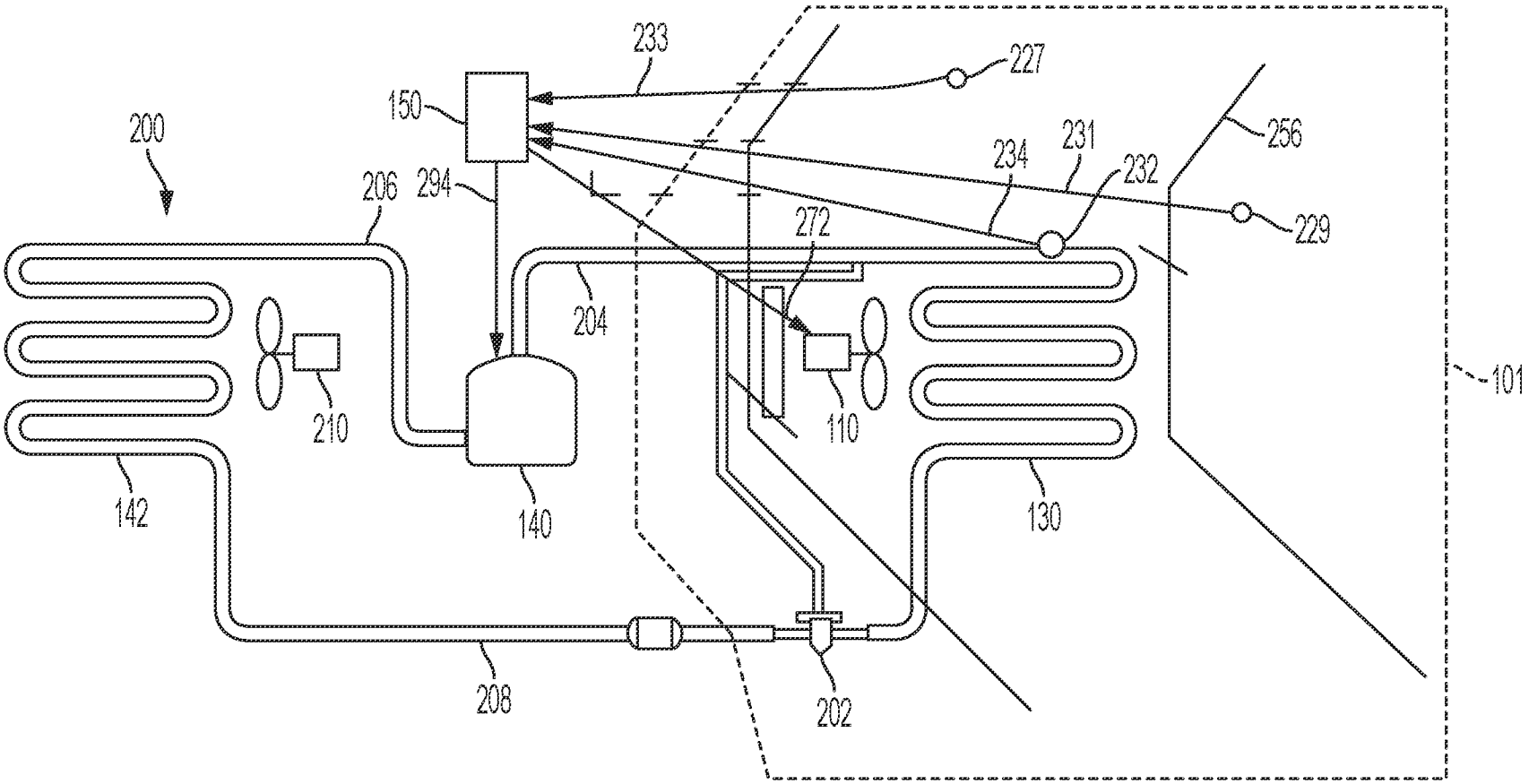
FIG. 2 is a schematic diagram of an exemplary HVAC system.

FIG. 2 is a schematic diagram of an exemplary HVAC system 200. For illustrative purposes, FIG. 2 will be described herein relative to FIG. 1. The HVAC system 200 includes the refrigerant evaporator coil 130, the condenser coil 142, the variable-speed compressor 140, and a metering device 202. In a typical embodiment, the metering device 202 is, for example, a thermostatic expansion valve or a throttling valve. The refrigerant evaporator coil 130 is fluidly coupled to the variable-speed compressor 140 via a suction line 204. The variable-speed compressor 140 is fluidly coupled to the condenser coil 142 via a discharge line 206. The condenser coil 142 is fluidly coupled to the metering device 202 via a liquid line 208.

Still referring to FIG. 2, during operation, low-pressure, low-temperature refrigerant is circulated through the refrigerant evaporator coil 130. The refrigerant is initially in a liquid/vapor state. In a typical embodiment, the refrigerant is, for example, R-22. R-134a. R-410A, R-744, or any other suitable type of refrigerant as dictated by design requirements. Air from within the enclosed space 101, which is typically warmer than the refrigerant, is circulated around the refrigerant evaporator coil 130 by the variable-speed circulation fan 110. In a typical embodiment, the refrigerant begins to boil after absorbing heat from the air and changes state to a low-pressure, low-temperature, super-heated vapor refrigerant. Saturated vapor, saturated liquid, and saturated fluid refer to a thermodynamic state where a liquid and its vapor exist in approximate equilibrium with each other. Super-heated fluid and super-heated vapor refer to a thermodynamic state where a vapor is heated above a saturation temperature of the vapor. Sub-cooled fluid and sub-cooled liquid refers to a thermodynamic state where a liquid is cooled below the saturation temperature of the liquid.

The low-pressure, low-temperature, super-heated vapor refrigerant is introduced into the variable-speed compressor 140 via the suction line 204. In a typical embodiment, the variable-speed compressor 140 increases the pressure of the low-pressure, low-temperature, super-heated vapor refrigerant and, by operation of the ideal gas law, also increases the temperature of the low-pressure, low-temperature, super-heated vapor refrigerant to form a high-pressure, high-temperature, superheated vapor refrigerant. The high-pressure, high-temperature, superheated vapor refrigerant enters the condenser coil 142.

Outside air is circulated around the condenser coil 142 by a variable-speed condenser fan 210. The outside air is typically cooler than the high-pressure, high-temperature, superheated vapor refrigerant present in the condenser coil 142. Thus, heat is transferred from the high-pressure, high-temperature, superheated vapor refrigerant to the outside air. Removal of heat from the high-pressure, high-temperature, superheated vapor refrigerant causes the high-pressure, high-temperature, superheated vapor refrigerant to condense and change from a vapor state to a high-pressure, high-temperature, sub-cooled liquid state. The high-pressure, high-temperature, sub-cooled liquid refrigerant leaves the condenser coil 142 via the liquid line 208 and enters the metering device 202.

In the metering device 202, the pressure of the high-pressure, high-temperature, sub-cooled liquid refrigerant is abruptly reduced. In various embodiments where the metering device 202 is, for example, a thermostatic expansion valve, the metering device 202 reduces the pressure of the high-pressure, high-temperature, sub-cooled liquid refrigerant by regulating an amount of refrigerant that travels to the refrigerant evaporator coil 130. Abrupt reduction of the pressure of the high-pressure, high-temperature, sub-cooled liquid refrigerant causes rapid evaporation of a portion of the high-pressure, high-temperature, sub-cooled liquid refrigerant, commonly known as flash evaporation. The flash evaporation lowers the temperature of the resulting liquid/vapor refrigerant mixture to a temperature lower than a temperature of the air in the enclosed space 101. The liquid/vapor refrigerant mixture leaves the metering device 202 and returns to the refrigerant evaporator coil 130.

Referring to FIG. 2, a first temperature sensor 227 is disposed in the supply duct 256. In a typical embodiment, the first temperature sensor 227 is a thermocouple, a thermometer, a thermistor, or other appropriate temperature-measuring device. The first temperature sensor 227 measures the DAT and transmits the DAT to the HVAC controller 150. Communication between the first temperature sensor 227 and the HVAC controller 150 is illustrated graphically in FIG. 2 by arrow 233. In a typical embodiment, the first temperature sensor 227 continuously measures the DAT; however, in other embodiments, the first temperature sensor 227 measures the DAT at periodic time intervals such as, for example, every five seconds. In a typical embodiment, the first temperature sensor 227 is electrically coupled to the HVAC controller 150 via a wired connection; however, in other embodiments, the first temperature sensor 227 is connected to the HVAC controller 150 via a wireless connection.

A second temperature sensor 229 is disposed in the enclosed space 101. In a typical embodiment, the second temperature sensor 229 is a thermocouple, a thermometer, a thermistor, or other appropriate temperature-measuring device. The second temperature sensor 229 measures an air temperature within the enclosed space 101. In various embodiments, the second temperature sensor 229 and the HVAC controller 150 are integral; however, in other embodiments, the second temperature sensor 229 and the HVAC controller 150 are separate devices thereby allowing the HVAC controller to be located outside of the enclosed space 101. In a typical embodiment, the second temperature sensor 229 continuously measures the temperature of the enclosed space 101; however, in other embodiments, the second temperature sensor 229 measures the temperature of the enclosed space 101 at periodic time intervals such as, for example, every five seconds. In a typical embodiment, the second temperature sensor 229 is electrically coupled to the HVAC controller 150 via a wired connection; however, in other embodiments, the second temperature sensor 229 is connected to the HVAC controller 150 via a wireless connection. Communication between the second temperature sensor 229 and the HVAC controller 150 is illustrated graphically in FIG. 2 by arrow 231.

A third temperature sensor 232 is disposed within or in relation to the evaporator coil 130. In various embodiments, the third temperature sensor 232 may be, for example, a thermocouple, a thermometer, a pressure transducer, a thermostat, a thermistor, or any other appropriate sensor. The third temperature sensor 232 measures SST and transmits the SST to the HVAC controller 150. In some embodiments, the third temperature sensor 232 may be disposed on an exterior surface of the evaporator coil 130 thereby using an evaporator coil 130 surface temperature as a proxy measurement for the SST. Communication between the third temperature sensor 232 and the HVAC controller 150 is illustrated graphically in FIG. 2 by arrow 234. In a typical embodiment, the third temperature sensor 232 continuously measures the SST; however, in other embodiments, the third temperature sensor 232 measures the SST at periodic time intervals such as, for example, every five seconds. In a typical embodiment, the third temperature sensor 232 is electrically coupled to the HVAC controller 150 via a wired connection; however, in other embodiments, the third temperature sensor 232 is connected to the HVAC controller 150 via a wireless connection. In certain embodiments in which the variable-speed compressor 140 is representative of multiple compressors, the third temperature sensor 232 can be representative of a plurality of such sensors. For example, a plurality of sensors similar to the third temperature sensor 232 may be positioned for measuring SST at different locations at or on the evaporator coil 130.

In various embodiments, the HVAC controller 150 can use the second temperature sensor 229 to establish a DAT setpoint. As mentioned previously, the second temperature sensor 229 transmits the temperature of the enclosed space 101 to the HVAC controller 150. When the temperature of the enclosed space 101 is at or above a maximum threshold such as, for example, 80° F., the HVAC controller 150 establishes the DAT setpoint at a first setpoint temperature such as, for example, approximately 50° F. When the temperature of the enclosed space 101 is at or below a minimum threshold such as, for example, 70° F. the HVAC controller 150 establishes the DAT setpoint at a second setpoint temperature such as, for example, 45° F., thereby lowering the DAT setpoint from the first setpoint temperature to the second setpoint temperature as the temperature of the enclosed space 101 falls. In a typical embodiment, the minimum threshold, the maximum threshold, the first setpoint temperature, and the second setpoint temperature may be adjusted according to the preferences of an occupant of the enclosed space 101. When the temperature of the enclosed space 101 is between the maximum threshold and the minimum threshold such as, for example, between 70° F. and 80° F., the HVAC controller 150 establishes the DAT setpoint at a value between the first setpoint temperature and the second setpoint temperature in a linear fashion relative to the temperature of the enclosed space 101.

In various embodiments, the HVAC controller 150 can use the third temperature sensor 232 to adapt an established DAT setpoint, when deemed appropriate, to prevent evaporator coil freeze. In various embodiments, the HVAC controller 150 can monitor the third temperature sensor 232. When the SST is less than a minimum SST threshold, the HVAC controller can adapt or adjust the established DAT setpoint in accordance with a configurable algorithm. Examples of adapting the DAT setpoint will be described relative to FIGS. 5-9.

In a typical embodiment, the HVAC controller 150 modulates the variable-speed compressor 140 and/or the variable-speed circulation fan 110 to vary the DAT in response to changes in the DAT setpoint. For example, the DAT can be increased by reducing a speed of the variable-speed compressor 140 or by increasing a speed of the variable-speed circulation fan 110. Similarly, the DAT can be decreased by increasing a speed of the variable-speed compressor 140 or by decreasing a speed of the variable-speed circulation fan 110. Signaling of the variable-speed compressor 140 by the HVAC controller 150 is illustrated in FIG. 2 by way of arrow 294. Signaling of the variable-speed circulation fan 110 by the HVAC controller 150 is illustrated in FIG. 2 by arrow 272. In a typical embodiment, cooling demand of the HVAC system 200 will be tied to one of the speed of the variable-speed compressor 140 and the speed of the variable-speed circulation fan 110. In embodiments where cooling demand is tied to the speed of the variable-speed compressor 140, the speed of the variable-speed circulation fan 110 may be adjusted. In embodiments where cooling demand is tied to the speed of the variable-speed circulation fan 110, the speed of the variable-speed compressor 140 may be adjusted.

FIG. 3 illustrates an example implementation 300 involving multiple compressors. The implementation 300 includes compressors 340*a*, 340*b*, 340*c* and 340*d* that are operable to operate off of an evaporator coil 330 that includes multiple evaporator circuits 345. SST sensors 332*a*, 332*b*. 332*c* and 332*d* (collectively, SST sensors 332) are disposed in different locations in or on the evaporator coil 330 and are operable to measure SST. In general, the SST sensors 332 can each operate as described relative to the third temperature sensor 232 of FIG. 2. It should be appreciated that the number and arrangement of compressors. SST sensors, and evaporator circuits can be varied to suit a given implementation. For example, various implementations may include more or fewer than four compressors and/or more or fewer than four temperature sensors.

Figure 4:
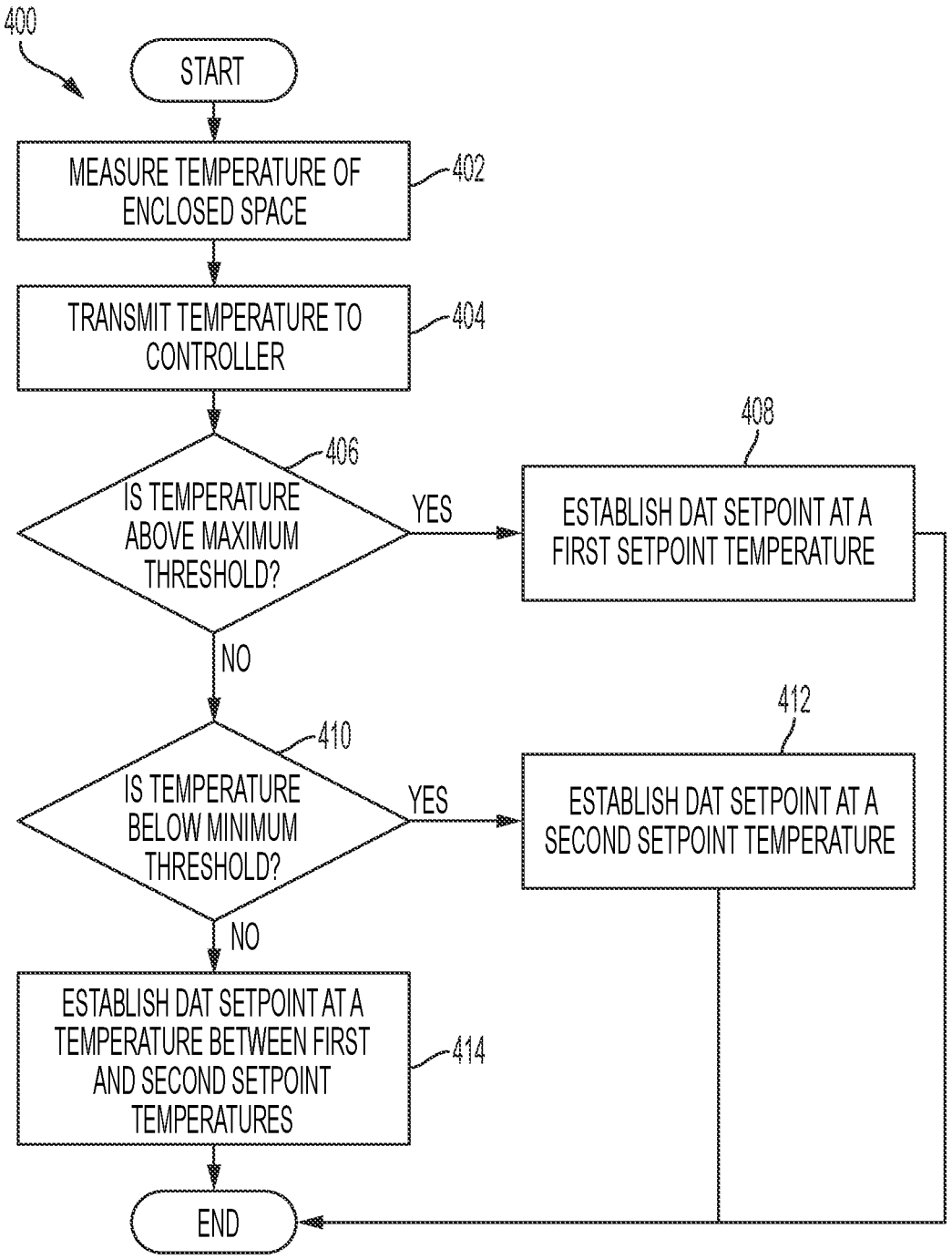
FIG. 4 is a flow diagram of a process for establishing a discharge air temperature (DAT) setpoint.

FIG. 4 is a flow diagram of a process 400 for establishing a DAT setpoint. For illustrative purposes, the process 400 will be described relative to FIGS. 1-2B. At block 402, the second temperature sensor 229 measures a temperature of the enclosed space 101. At block 404, the second temperature sensor 229 transmits the temperature of the enclosed space 101 to the HVAC controller 150. At decision block 406, the HVAC controller 150 determines if the temperature of the enclosed space 101 is above a maximum threshold such as, for example, approximately 80° F. If it is determined at decision block 406 that the temperature of the enclosed space 101 is at or above the maximum threshold, the process 400 proceeds to block 408. At block 408, the HVAC controller 150 establishes the DAT setpoint at a first setpoint temperature such as, for example, approximately 50° F. However, if it is determined at decision block 406 that the temperature of the enclosed space 101 is below the maximum threshold, the process 400 proceeds to decision block 410.

At decision block 410, the HVAC controller 150 determines if the temperature of the enclosed space 101 is at or below a minimum threshold such as, for example, approximately 70° F. If it is determined at decision block 410 that the temperature of the enclosed space 101 is below the minimum threshold, the process 400 proceeds to block 412. At block 412, the HVAC controller establishes the DAT setpoint at a second setpoint temperature such as, for example, approximately 45° F. After block 412, the process 400 ends. However, if it is determined at decision block 410 that the temperature of the enclosed space 101 is between the minimum threshold and the maximum threshold, the process 400 proceeds to block 414.

At block 414, the HVAC controller 150 establishes the DAT setpoint at a temperature between the first temperature setpoint and the second temperature setpoint. In some cases, the HVAC controller 150 can vary the DAT setpoint with the temperature of the enclosed space 101 in a linear fashion. Thus, in such cases, the DAT can vary proportionally with the temperature of the enclosed space 101 when the temperature of the enclosed space 101 is between the maximum threshold and the minimum threshold such as, for example, 70° F. and 80° F. In a typical embodiment, the minimum threshold, the maximum threshold, the first setpoint temperature, and the second setpoint temperature may be adjusted according to the preferences of an occupant of the enclosed space 101. After block 414, the process 400 ends.

Figure 5:
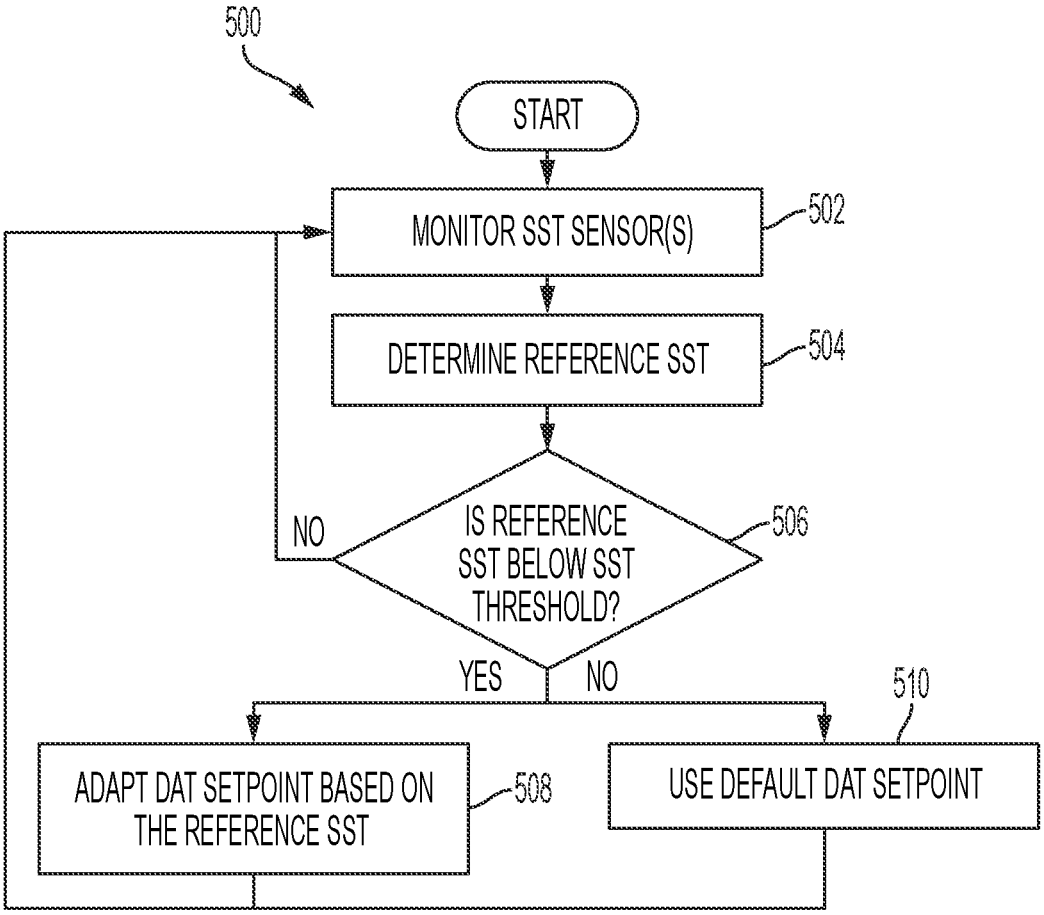
FIG. 5 is a flow diagram of a process configurably adapting an established DAT setpoint.

FIG. 5 is a flow diagram of a process 500 for configurably adapting an established DAT setpoint to prevent evaporator coil freeze. For illustrative purposes, the process 500 will be described relative to FIGS. 1-2B and 3. At block 502, the HVAC controller 150 monitors the third temperature sensor 232. As described previously, particularly with reference to FIG. 3, the third temperature sensor 232 can be representative of multiple SST sensors. In these embodiments, the monitoring can include monitoring, for example, multiple SST sensors similar to the SST sensors 332 of FIG. 3. As described previously, each third temperature sensor 232 periodically transmits SSTs to the HVAC controller 150.

At block 504, the HVAC controller 150 determines a reference SST ($SST_{REF}$) via each third temperature sensor 232. In general, $SST_{REF}$ can be any value deemed to represent SST for all or part of the evaporator coil 130. In various embodiments, $SST_{REF}$ can be a result of an automated analysis or computation using SSTs transmitted by each third temperature sensor 232. For example, block 504 can involve the HVAC controller 150 determining a plurality of SSTs (e.g., a most recent SST for each third temperature sensor 232) and determining a minimum SST of the plurality of SSTs, where the minimum SST serves as $SST_{REF}$. In embodiments in which the third temperature sensor 232 represents only a single SST sensor, $SST_{REF}$ can be the most recent SST provided by that single SST sensor.

At decision block 506, the HVAC controller 150 determines whether $SST_{REF}$ is below a configurable minimum SST threshold ($SST_{Thresh}$). In various embodiments. $SST_{Thresh}$ can be set to a value that is configurably above an applicable freezing point. In various examples in which the applicable freezing point is 32° F., $SST_{Thresh}$ may be set to 33° F., 34° F. 36° F. 38° F. or any other suitable temperature. If it is determined at decision block 506 that $SST_{REF}$ is not below $SST_{Thresh}$, the process 500 proceeds to block 510. At block 510, the HVAC controller 150 uses a previously established or default DAT setpoint. The previously established or default DAT setpoint may correspond to a setpoint that would otherwise be used in the absence of the process 500, such as a setpoint established via the process 400 of FIG. 4. From block 510, the process 500 returns to the block 502 and executes as described previously.

If it is determined at the decision block 506 that $SST_{REF}$ is below $SST_{Thresh}$, the process 500 proceeds to block 508. At block 508, the HVAC controller 150 adapts the DAT setpoint based on $SST_{REF}$. For example, the block 508 can include determining an adapted setpoint value ($DAT_SP_{Adapt}$) using $SST_{REF}$ and setting the DAT setpoint to $DAT_SP_{Adapt}$. In some embodiments. $DAT_SP_{Adapt}$ can vary with $SST_{REF}$ between a minimum value ($DAT_SP_{Low}$) and a maximum value ($DAT_SP_{High}$). In a typical embodiment, if $SST_{REF}$ is decreasing and the DAT setpoint is less than $DAT_SP_{High}$, block 508 will amount to increasing the DAT setpoint. Conversely, in a typical embodiment, if $SST_{REF}$ is increasing, although remaining below $SST_{Thresh}$, block 508 will amount to decreasing the DAT setpoint. In this fashion, the HVAC controller 150 can adjust the DAT setpoint in each iteration through the block 508 in response to a then-existing $SST_{REF}$. After block 508, the process 500 returns to block 502 and executes as described previously. In various embodiments, the process 500 can continue to execute until terminated by a user or administrator or until other suitable stop criteria is satisfied.

Equation 1 and Equation 2 below provide examples of how to determine $DAT_SP_{Adapt}$, for example, during the block 508 of the process 500 of FIG. 5. In the example of Equation 1 and Equation 2. $DAT_SP_{Adapt}$ can vary linearly with $SST_{REF}$ between $DAT_SP_{Low}$ and $DAT_SP_{High}$. In certain embodiments, with reference to the process 400 of FIG. 4. $DAT_SP_{High}$ may correspond to the first setpoint temperature and represent a value used in cooling mode. In these embodiments. $DAT_SP_{Low}$ may correspond to the second setpoint temperature and represent a value used in dehumidification mode.

$$DAT_SP_{Adapt} = DAT_SP_{Low} + (SST_{Thresh} - \mathrm{MIN}(SST_{Thresh}, SST_{REF})) \quad \text{Equation 1}$$

$$DAT_SP_{Adapt} = DAT_SP_{Low} + \mathrm{MAX}\left(0, \frac{\mathrm{MIN}(1, (SST_{Thresh} - SST_{REF}))}{SST_{Thresh} - 32}\right) * (DAT_SP_{High} - DAT_SP_{Low}) \quad \text{Equation 2}$$

Although examples of linear functions are provided above for simplicity of description, one skilled in the art will appreciate that $DAT_SP_{Adapt}$ can also vary non-linearly with $SST_{REF}$ between $DAT_SP_{Low}$ and $DAT_SP_{High}$. For example, $DAT_SP_{Adapt}$ can be established using a polynomial function. Non-linear variation, such as by way of a polynomial function, can be advantageous to provide more significant and responsive change depending on a value of $SST_{REF}$. According to this example, in cases where the DAT setpoint is being algorithmically increased as described previously, relatively lower values of $SST_{REF}$ (e.g., values close to an applicable freezing point) can result in a steeper increase to $DAT_SP_{Adapt}$ than relatively higher values according to a polynomial curve. Similarly, in cases where the DAT setpoint is being algorithmically decreased as described previously, relatively higher values of $SST_{REF}$ (e.g., values closer to $SST_{Thresh}$) can result in a steeper decrease to $DAT_SP_{Adapt}$ than relatively lower values according to the polynomial curve.

In some embodiments, a process for configurably adapting an established DAT setpoint, such as the process 500 of FIG. 5, or portions thereof, may only be performed in particular modes of a given HVAC system. These modes generally have operational characteristics that lower DAT and thus increase a risk of evaporator coil freeze. For example, with reference to the HVAC system 100 of FIG. 1, the process 500 may only be performed when the HVAC system 100 is in dehumidification mode. In addition, or alternatively, in certain embodiments, some portions of the process 500 may be performed in all modes of the HVAC system 100 (e.g., blocks 502-504), while functionality to adapt a DAT setpoint (e.g., blocks 506-510) may only be performed in dehumidification mode of the HVAC system 100. Other variations and potential preconditions will be apparent to one skilled in the art after a detailed review of the present disclosure.

Figure 6:
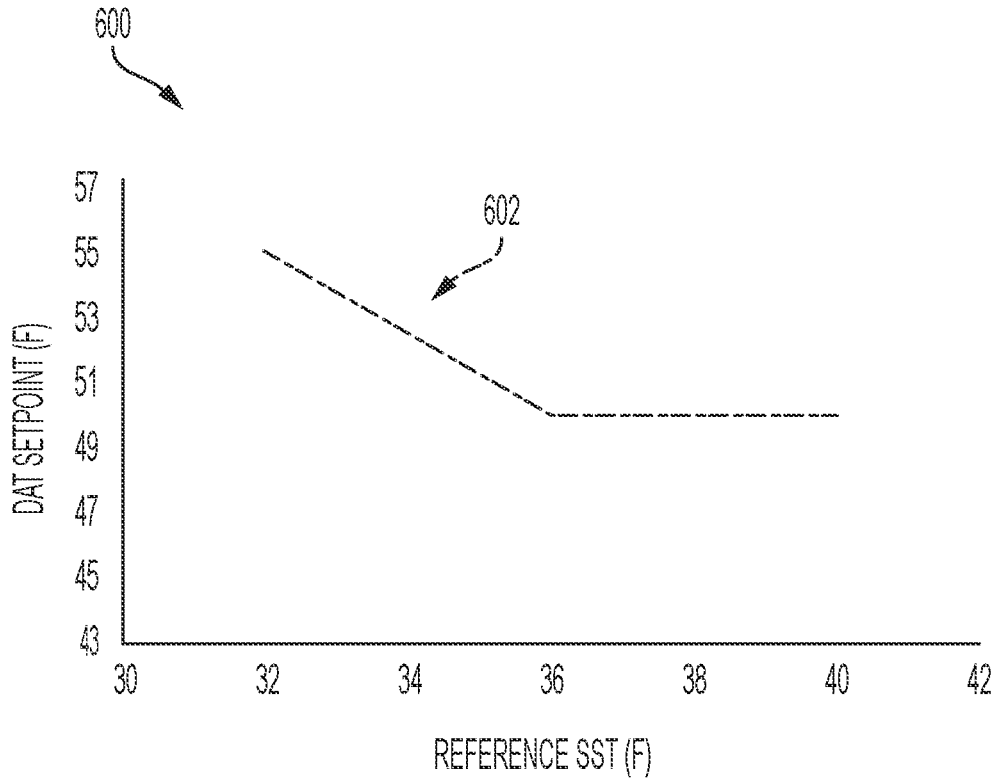
FIG. 6 is a graph that shows example variation in a DAT setpoint.

FIG. 6 is a graph 600 that shows example variation in a DAT setpoint 602. In the example of FIG. 6, $SST_{Thresh}$ is set to approximately 36° F. and $DAT_SP_{Low}$ is approximately 50° F. When $SST_{REF}$ is below $SST_{Thresh}$, the DAT setpoint 602 corresponds to a $DAT_SP_{Adapt}$ according to Equation 1 above. Otherwise, when $SST_{REF}$ is not below $SST_{Thresh}$, the DAT setpoint corresponds to $DAT_SP_{Low}$.

Figure 7:
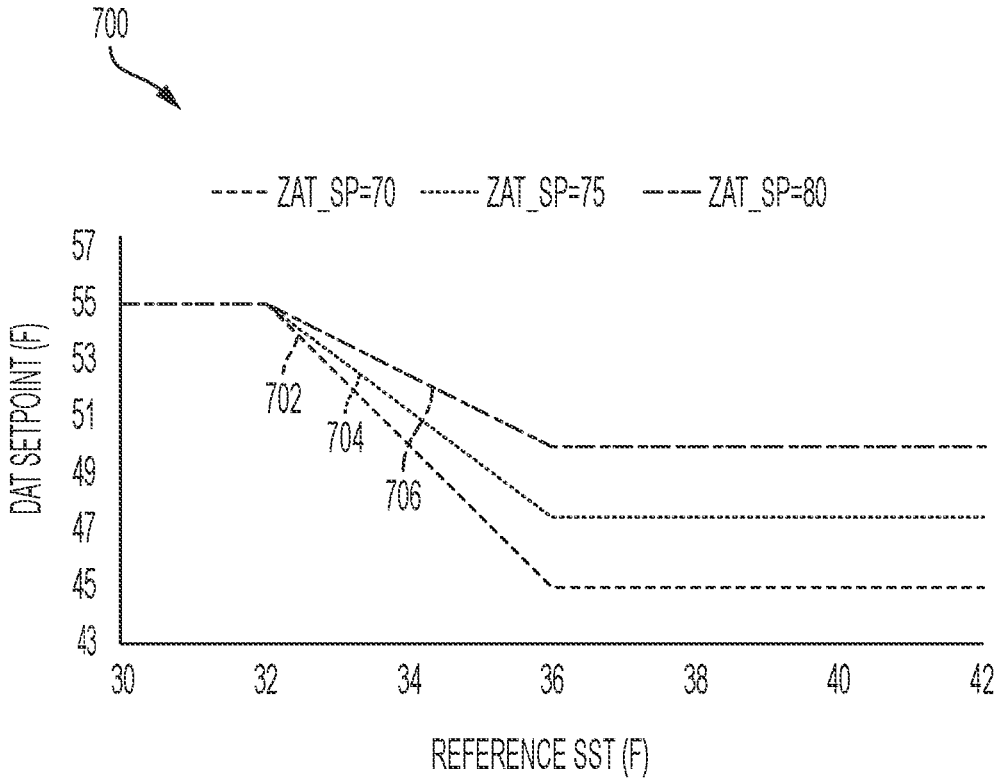
FIG. 7 is a graph that shows example variation in DAT setpoints for three different user-set temperature setpoints for an enclosed space.

FIG. 7 is a graph 700 that shows example variation in DAT setpoints 702, 704 and 706 for three different user-set temperature setpoints for an enclosed space. In the example of FIG. 7, $SST_{Thresh}$ is set to approximately 36° F. and $DAT_SP_{High}$ is set to approximately 55° F. In the example of FIG. 7, $DAT_SP_{Low}$ is approximately 45° F. 47.5° F. and 50° F. for the DAT setpoints 702, 704 and 706, respectively. When $SST_{REF}$ is below $SST_{Thresh}$, the DAT setpoints 702, 704 and 706 each correspond to a $DAT_SP_{Adapt}$ according to Equation 2 above, thereby linearly varying with $SST_{REF}$ between $DAT_SP_{Low}$ and $DAT_SP_{High}$. Otherwise, when $SST_{REF}$ is not below $SST_{Thresh}$, the DAT setpoints 702, 704 and 706 each correspond to their respective $DAT_SP_{Low}$.

Figure 8:
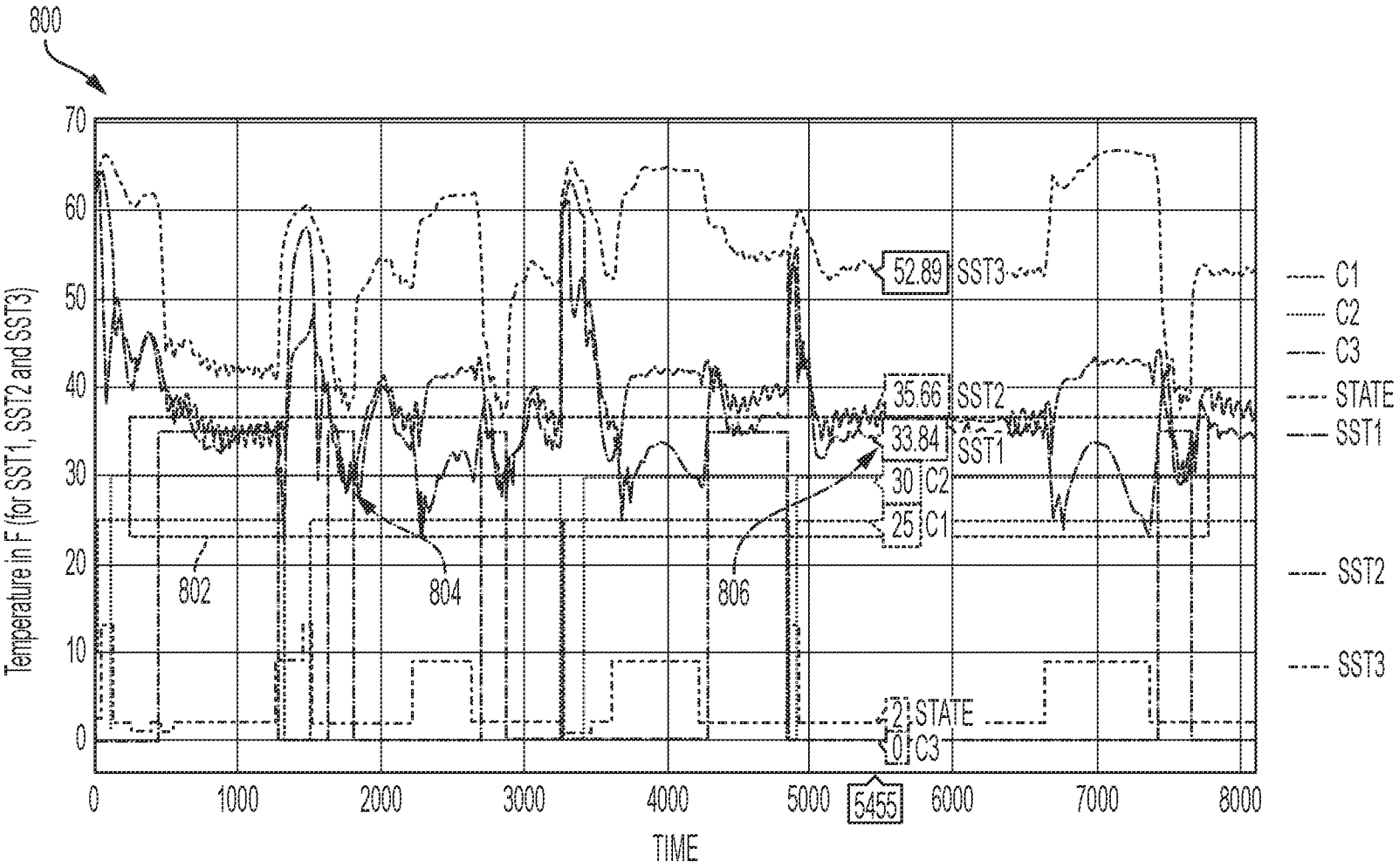
FIG. 8 is a graph that shows example saturate suction temperatures (SSTs) for a three-compressor system in which adaptive DAT setpoints are not utilized.

FIG. 8 is a graph 800 that shows example SSTs for a three-compressor system in which adaptive DAT setpoints are not utilized. In an area of focus 802, it can be seen that SST1 and SST2 for compressors C1 and C2, respectively, each approach an applicable freezing point of 32° F. Arrows 804 and 806 illustrate two example points of interest in the graph 800.

Figure 9:
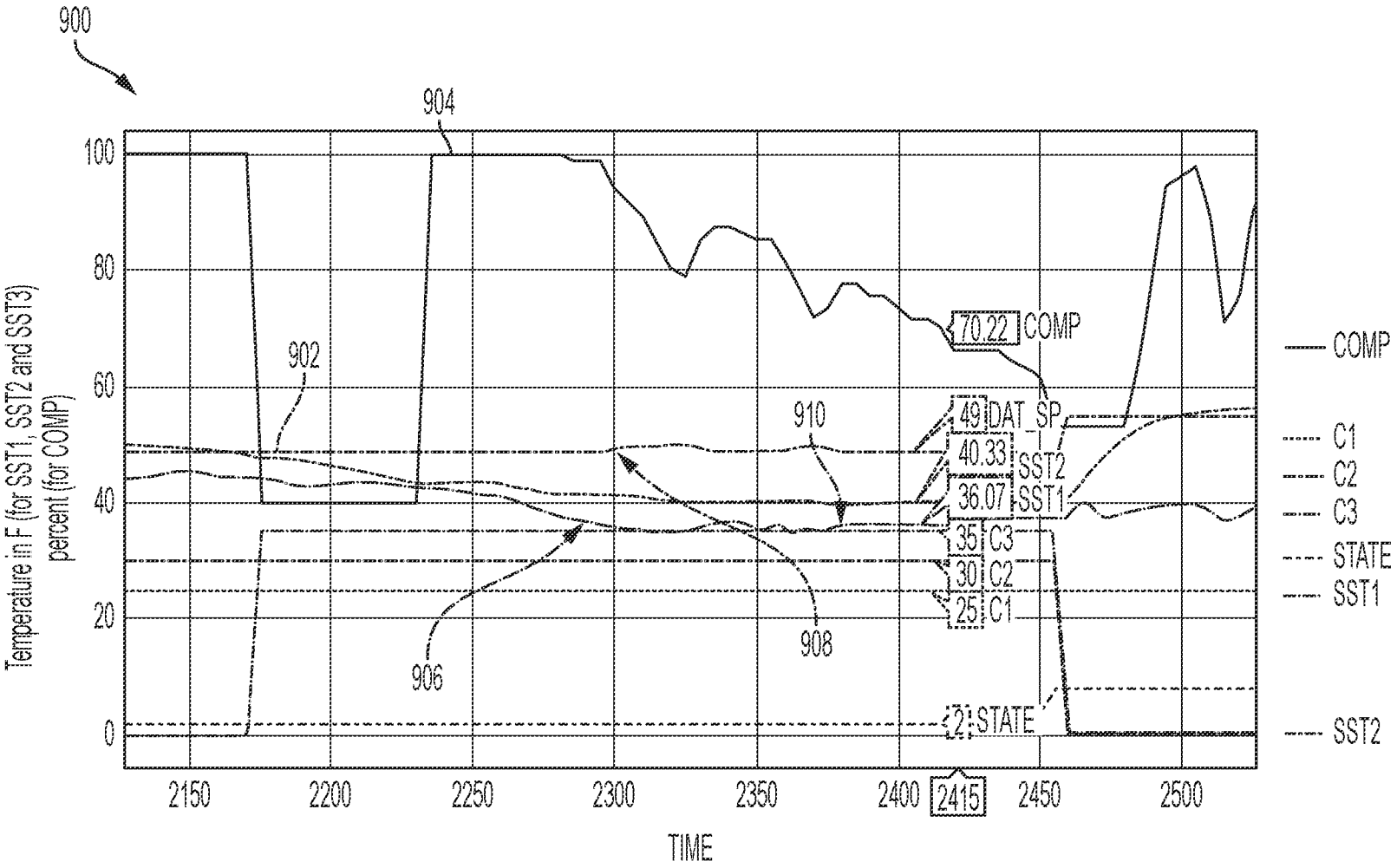
FIG. 9 is a graph that shows example SSTs for a three-compressor system that utilizes adaptive DAT setpoints.

FIG. 9 is a graph 900 that shows example SSTs for a three-compressor system that utilizes adaptive DAT setpoints. Arrows 906 and 908 illustrate that, as SST1 for a compressor C1 falls below $SST_{Thresh}$ (i.e., 36° F. in this example—see arrow 906), a DAT setpoint 902 begins to adapt, and thereby increase, in the fashion described above (see arrow 908). In the example of FIG. 9, the compressor C1 is a variable-speed compressor, with its compressor speed 904 decreasing in response to the aforementioned increase in the DAT setpoint 902. As indicated by arrow 910, SST1 for the compressor C1 is thereafter maintained at a temperature greater than the $SST_{Thresh}$.

For purposes of this patent application, the term computer-readable storage medium encompasses one or more tangible computer-readable storage media possessing structures. As an example and not by way of limitation, a computer-readable storage medium may include a semiconductor-based or other integrated circuit (IC) (such as, for example, a field-programmable gate array (FPGA) or an application-specific IC (ASIC)), a hard disk, an HDD, a hybrid hard drive (HHD), an optical disc, an optical disc drive (ODD), a magneto-optical disc, a magneto-optical drive, a floppy disk, a floppy disk drive (FDD), magnetic tape, a holographic storage medium, a solid-state drive (SSD), a RAM-drive, a SECURE DIGITAL card, a SECURE DIGITAL drive, a flash memory card, a flash memory drive, or any other suitable tangible computer-readable storage medium or a combination of two or more of these, where appropriate.

Particular embodiments may include one or more computer-readable storage media implementing any suitable storage. In particular embodiments, a computer-readable storage medium implements one or more portions of the HVAC controller 150, one or more portions of the user interface 170, one or more portions of the zone controller 180, or a combination of these, where appropriate. In particular embodiments, a computer-readable storage medium implements RAM or ROM. In particular embodiments, a computer-readable storage medium implements volatile or persistent memory. In particular embodiments, one or more computer-readable storage media embody encoded software.

In this patent application, reference to encoded software may encompass one or more applications, bytecode, one or more computer programs, one or more executables, one or more instructions, logic, machine code, one or more scripts, or source code, and vice versa, where appropriate, that have been stored or encoded in a computer-readable storage medium. In particular embodiments, encoded software includes one or more application programming interfaces (APIs) stored or encoded in a computer-readable storage medium. Particular embodiments may use any suitable encoded software written or otherwise expressed in any suitable programming language or combination of programming languages stored or encoded in any suitable type or number of computer-readable storage media. In particular embodiments, encoded software may be expressed as source code or object code. In particular embodiments, encoded software is expressed in a higher-level programming language, such as, for example, C. Python. Java, or a suitable extension thereof. In particular embodiments, encoded software is expressed in a lower-level programming language, such as assembly language (or machine code). In particular embodiments, encoded software is expressed in JAVA. In particular embodiments, encoded software is expressed in Hyper Text Markup Language (HTML). Extensible Markup Language (XML), or other suitable markup language.

Depending on the embodiment, certain acts, events, or functions of any of the algorithms described herein can be performed in a different sequence, can be added, merged, or left out altogether (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. Although certain computer-implemented tasks are described as being performed by a particular entity, other embodiments are possible in which these tasks are performed by a different entity.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

What is claimed is:

1. A method of preventing evaporator coil freeze in a heating, ventilation and air conditioning (HVAC) system, the method comprising, by a controller in the HVAC system, the controller configured for wireless communication and comprising a processor and a memory:

determining, via at least one sensor disposed on an evaporator coil in the HVAC system, a reference saturated suction temperature (SST), wherein determining the reference SST comprises determining a plurality of SSTs via a plurality of sensors disposed on the evaporator coil and determining a minimum SST of the plurality of SSTs, wherein the minimum SST is the reference SST;

determining, by the controller, whether the reference SST is below a minimum SST threshold;

responsive to a determination that the reference SST is below the minimum SST threshold, increasing, by the controller, a discharge air temperature (DAT) setpoint;

determining, by the controller, an adapted setpoint value using the reference SST; and setting, by the controller, the DAT setpoint to the adapted setpoint value.

2. The method of claim 1, wherein the adapted setpoint value varies linearly with the reference SST between a minimum value and a maximum value.

3. The method of claim 2, wherein the minimum value comprises a DAT setpoint value used in a dehumidification mode and the maximum value comprises a DAT setpoint value used in a cooling mode.

4. The method of claim 1, wherein the adapted setpoint value varies non-linearly with the reference SST between a minimum value and a maximum value.

5. The method of claim 1, wherein the evaporator coil comprises a plurality of evaporator circuits apportioned to a plurality of compressors in the HVAC system, the plurality of sensors comprising at least one sensor disposed on each of the plurality of evaporator circuits.

6. The method of claim 1, comprising:

determining a second reference SST via the at least one sensor; and adjusting the DAT setpoint in response to the second reference SST.

7. The method of claim 1, comprising:

determining a second reference SST via the at least one sensor;

determining whether the second reference SST is below the minimum SST threshold; and responsive to a determination that the second reference SST is not below the minimum SST threshold, decreasing the DAT setpoint to a previous setpoint value.

8. The method of claim 1, comprising:

determining whether the HVAC system is in a dehumidification mode; and wherein the determining whether the reference SST is below the minimum SST threshold is performed responsive to a determination that the HVAC system is in the dehumidification mode.

9. The method of claim 1, comprising:

determining whether the HVAC system is in a dehumidification mode; and wherein the determining the reference SST is performed responsive to a determination that the HVAC system is in the dehumidification mode.

10. A heating, ventilation, and air conditioning (HVAC) system comprising:

an evaporator coil;

at least one sensor disposed on the evaporator coil;

a compressor fluidly coupled to a condenser coil and the evaporator coil; and a controller operatively coupled to the compressor, wherein the controller is operable to perform a method comprising:

determining a reference saturated suction temperature (SST) via the at least one sensor, wherein determining the reference SST comprises determining a plurality of SSTs via a plurality of sensors disposed on the evaporator coil and determining a minimum SST of the plurality of SSTs, wherein the minimum SST is the reference SST;

determining whether the reference SST is below a minimum SST threshold;

responsive to a determination that the reference SST is below the minimum SST threshold, increasing a discharge air temperature (DAT) setpoint;

determining an adapted setpoint value using the reference SST; and setting the DAT setpoint to the adapted setpoint value.

11. The HVAC system of claim 10, wherein the adapted setpoint value varies linearly with the reference SST between a minimum value and a maximum value.

12. The HVAC system of claim 11, wherein the minimum value comprises a DAT setpoint value used in a dehumidification mode and the maximum value comprises a DAT setpoint value used in a cooling mode.

13. The HVAC system of claim 10, wherein the evaporator coil comprises a plurality of evaporator circuits apportioned to a plurality of compressors in the HVAC system, the plurality of sensors comprising at least one sensor disposed on each of the plurality of evaporator circuits.

14. The HVAC system of claim 10, the method comprising:

determining a second reference SST via the at least one sensor; and adjusting the DAT setpoint in response to the second reference SST.

15. The HVAC system of claim 10, the method comprising:

determining a second reference SST via the at least one sensor;

determining whether the second reference SST is below the minimum SST threshold; and responsive to a determination that the second reference SST is not below the minimum SST threshold, decreasing the DAT setpoint to a previous setpoint value.

16. A computer-program product comprising a non-transitory computer-usable medium having computer-readable program code embodied therein, the computer-readable program code adapted to be executed to implement a method of preventing evaporator coil freeze utilizing a controller in an HVAC system, the controller configured for wireless communication and comprising a processor and a memory, the method comprising:

determining, via at least one sensor disposed on an evaporator coil in the HVAC system, a reference saturated suction temperature (SST)), wherein determining the reference SST comprises determining a plurality of SSTs via a plurality of sensors disposed on the evaporator coil and determining a minimum SST of the plurality of SSTs, wherein the minimum SST is the reference SST;

determining, by the controller, whether the reference SST is below a minimum SST threshold;

responsive to a determination that the reference SST is below the minimum SST threshold, increasing, by the controller, a discharge air temperature (DAT) setpoint;

determining, by the controller, an adapted setpoint value using the reference SST; and setting, by the controller, the DAT setpoint to the adapted setpoint value.

* * * * *